US006312359B1

(12) United States Patent
Brundle

(10) Patent No.: US 6,312,359 B1
(45) Date of Patent: Nov. 6, 2001

(54) GRIP EXERCISE APPARATUS

(76) Inventor: Robert P. Brundle, 6055 McCandlish, Grand Blanc, MI (US) 48439

( * ) Notice: Subject to any disclaimer, the term of this patent is extended or adjusted under 35 U.S.C. 154(b) by 0 days.

(21) Appl. No.: 09/540,964

(22) Filed: Mar. 31, 2000

(51) Int. Cl.[7] ..... A63B 23/00
(52) U.S. Cl. ..... 482/46
(58) Field of Search ..... 482/44–49, 50

(56) References Cited

U.S. PATENT DOCUMENTS 5,547,441 * 8/1996 Mora ..... 482/46
5,620,398 * 4/1997 Moriarty ..... 482/46
6,099,437 * 8/2000 DeMers ..... 482/46

* cited by examiner

*Primary Examiner*—Glenn E. Richman
(74) *Attorney, Agent, or Firm*—Young & Basile, PC

(57) ABSTRACT

A grip exercise apparatus includes a bar having first and second opposed end portions and an intermediate center portion. A weight is attachable by a flexible weight support or line to the center portion of the bar and is wound and unwound about the center portion of the bar as the first and second end portions are rotated by a user's hands gripping the first and second end portions The weight may comprise a single weight element attached to the weight support or a weight carrier in the form of a closeable container adapted to receive individual weight elements.

18 Claims, 1 Drawing Sheet

GRIP EXERCISE APPARATUS

BACKGROUND OF THE INVENTION

1. Field of the Invention

The present invention relates, in general, to exercise apparatus.

2. Description of the Art

Various exercise devices have been created to strengthen different muscles of the human body for general health or for added strength and for flexibility for specific activities or sports.

Many sports use a hitting element, such as a baseball bat, golf club, tennis racket, etc. A strong handgrip is essential for proper bat, club or racket movement and contact with a ball.

However, some general purpose exercise equipment which can be used to strengthen a user's grip or to increase forearm strength is typically bulky, expensive, requires interchangeable weights or attachments and regular use at an exercise facility.

What is needed is a simple, inexpensive, affordable, easy to use exercise device for strengthening a user's handgrip and forearms.

SUMMARY OF THE INVENTION

The present invention is an exercise apparatus particularly suited for exercising and strengthening a user's handgrip and forearms.

In a preferred aspect of the invention, the exercise apparatus includes a bar having first and second opposed end portions, with each of the first and second end portions having hand grippable shapes. A weight is extensibly and retractably attached to the bar for movement toward and away from the bar as the bar is rotated by a user's hands gripping the first and second end portions.

The exercise apparatus further includes a windable and unwindable weight support attached to the weight and to a center portion of the bar. The weight support is windable and unwindable about the center portion of the bar as the bar is rotated.

The exercise apparatus also includes a weight carrier having an interior chamber adapted for receiving one or more weight elements. The weight element can include a plurality of discrete weight elements.

The center portion of the bar includes first and second spaced annular flanges, each disposed at an inner end of the first and second end portions of the bar. A support extends between the first and second spaced flanges. The weight including a weight support is connected to the cylindrical portion.

In one aspect, the bar is formed as a unitary, one-piece body.

In another aspect, the first and second end portions of the bar have a tapered or contoured exterior shape extending between a large diameter outer end and a smaller diameter inner end.

The grip exercise apparatus of the present invention provides an easy to use, portable, lightweight, inexpensive exercise device for strengthening a user's hand and forearm muscles to provide the user with a stronger grip for use in gripping and swinging various articles, such as sports equipment including golf clubs, baseball bats, tennis rackets, etc. The grip exercise apparatus may also be used for therapeutic purposes to strengthen injured hands, wrists and/or forearms. The grip exercise apparatus has a small shape to facilitate easy portability and storage thereby enhancing its use in many different locations which will facilitate repeated use of the exercise device. One or more discrete weight elements may be removably attached to the weight support coupled to the bar-shaped grip element to also facilitate easy portability and convenient storage since the weight elements can be disengaged from the grip element when not in use.

BRIEF DESCRIPTION OF THE DRAWING

The various features, advantages and other uses of the present invention will become more apparent by referring to following detailed description and drawing in which.

DESCRIPTION OF THE PREFERRED EMBODIMENT

Figure 1:
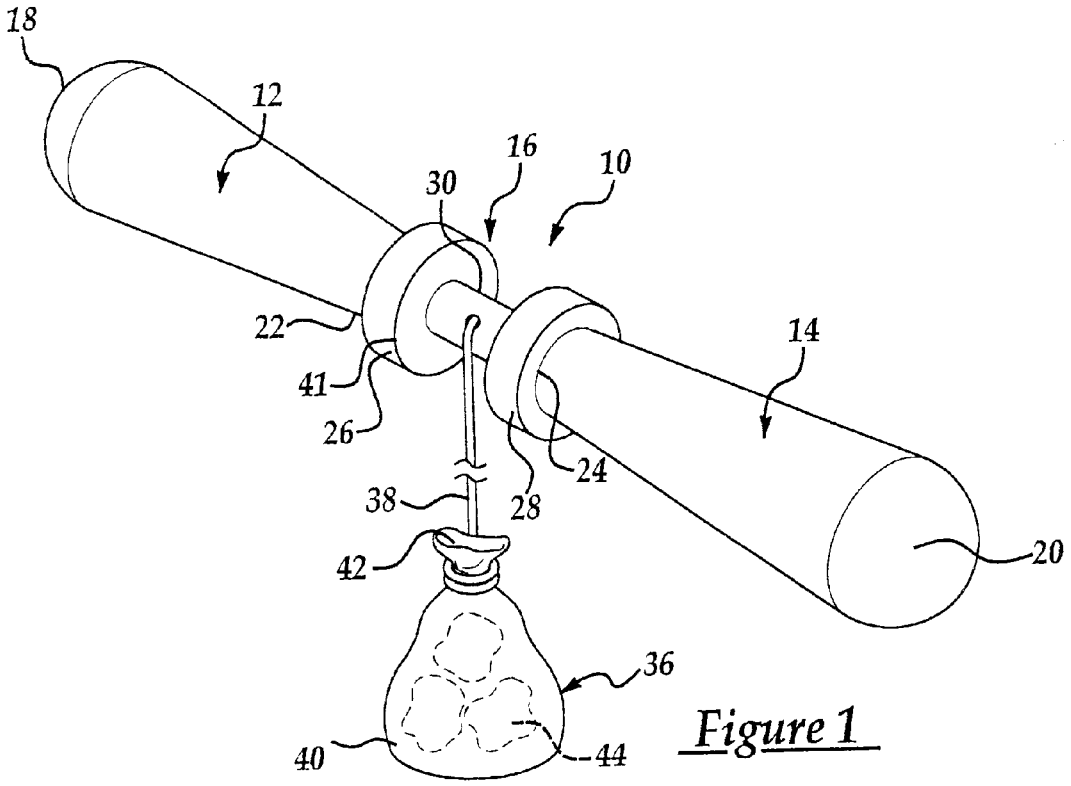
FIG. 1 is a perspective view of a grip exercise apparatus according to the present invention.
Figure 2:
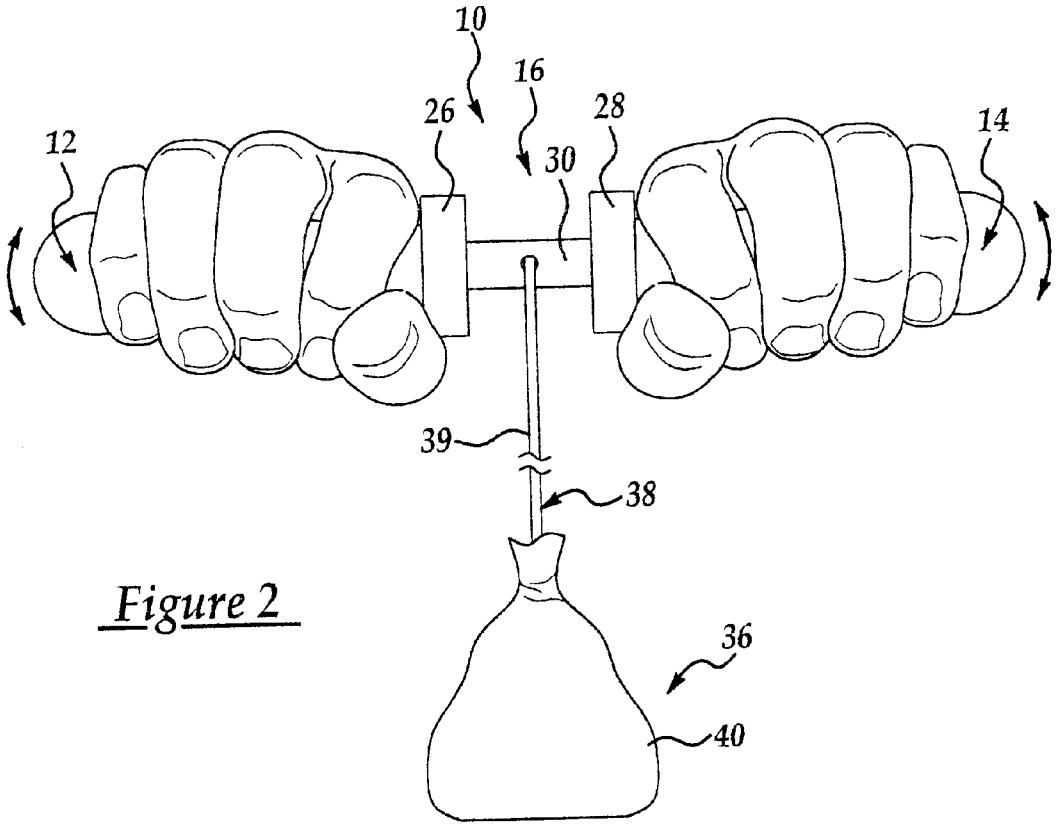
FIG. 2 is a front elevational view of the grip exercise apparatus depicted in a use position.

Referring now to the drawing, and to FIGS. 1 and 2 in particular, there is depicted a grip exercise apparatus 10 constructed in accordance with the present invention. The apparatus 10 includes a bar-shaped grip element formed of first and second end portions 12 and 14 which are interconnected by an intermediate, center portion 16.

The grip exercise apparatus or grip element 10 is illustrated as having a one-piece, unitary construction. However, it will be understood that the first and second end portions 12 and 14 and the center portion 16 may be formed as separate, distinct elements which are integrally joined together, such as by the use of fasteners, adhesive, interlocking connections, etc.

The grip element 10 may be formed of any suitable material, such as plastic, wood, metal, or combinations thereof. In a preferred example, the grip element 10 is formed of a one-piece, unitary, molded plastic material.

The first and second end portions 12 and 14 have a smoothly contoured or tapered shape extending from a hemispherically shaped, smooth outer end portion 18 and 20, respectively, to a smaller diameter inner portion 22 and 24. Although the shape of each of the first and second end portions 12 and 14 is illustrated as having a smoothly tapered cross section extending from the larger diameter outer end portions 18 and 20 to the smaller diameter inner portions 22 and 24, it will be understood that each of the first and second end portions 12 and 14 of the grip element 10 may have a constant cross section, cylindrical shape or a sinuous shape.

The inner end portions 22 and 24 of the first and second end portions 12 and 14 are unitarily connected to an annular flange 26 and 28, respectively. The flanges 26 and 28 form part of the center portion 16. The annular flanges 26 and 28, which are illustrated as being contiguous with the first and second end portions 12 and 14, respectively, have a larger diameter than the diameter of the inner end portions 22 and 24 of the grip element 10.

The center portion 16 includes a support member 30 in the form of a rod or pin extending between and joined to each of the flanges 26 and 28. The support 30 has a significantly smaller diameter than the diameter of the annular flanges 26 and 28 and is centrally disposed between the flanges 26 and 28 along a longitudinal axis extending between the outer ends 18 and 20 of the first and second end portions 12 and 14. In this manner, the annular flanges 26 and 28 and the support 30 define a centrally located, annular recess to permit coiling or winding and unwinding of a weight support, as described hereafter, about the support 30 and between the annular flanges 26 and 28, with the flanges 26 and 28 functioning to retain the coiled weight support therebetween.

A weight attachment, denoted generally by reference number 36, is attachable by a weight support 38 to the center support 30 of the grip element 10. The weight attachment 36 preferably includes a weight carrier 40 in the form of a container, such as a flexible bag having a closed interior accessible through an open end 42. Weight elements 44, which are illustrated by way of example only in the form of a plurality of golf balls, are removably mountable within the weight carrier 40. Any number and different type of weight elements 44 may be inserted into the weight carrier 40 to provide any desired total weight, including variably selectable weight in increments up to a maximum weight, such as 25 pounds, for example only. In addition to golf balls, the weight elements 44 may include sand or other particulate material, coin rolls, or any other element capable of adding a noticeable weight to the grip element 10, including a single mass material, such as a block of lead or other metal.

It will also be understood that the weight elements 44, when such weight elements have a suitable shape or are in the form a single mass, may be directly connected to the weight support 38 by tying one end of the weight support 38 to the weight element 44 thereby dispensing with the need for the weight carrier or container 40.

The weight support 38 is in the form of an elongated, substantially non-extensible line, string or cord 39, such as a cotton or nylon line or cord. The line 39 may be provided in any length, with a length of between 24 and 30 inches being preferred. One end of the line 39 is removably or permanently affixed to the weight carrier 40 or directly to the weight element 44 as described above where the weight element 44 lends itself to direct connection to the weight support 38. The other end of the line 39 is connected to the support 30 in the center portion 16 of the grip element 10. The attachment to the center support 30 may be implemented by tying one end of the weight support 38 about the center support 30. Alternately, and as shown in FIGS. 1 and 2, a through bore 41 is formed in the center support 30 for receiving one end of the weight support 38 which is then tied about a portion of the center support 30.

The grip exercise apparatus or grip element 10 of the present invention lends itself to easy portability as the weight element or elements 44 can be removed from the weight carrier 40 thereby enabling the grip element 10 to be easily stored in a briefcase or suitcase or even a pocket since the overall length of the grip element 10 is approximately 10 inches, by example only. When it is desired to use the grip element 10, any readily available weight elements 44 may be inserted into the weight carrier 40.

In use, the first and second end portions 12 and 14 are gripped by each hand of the user as shown in FIG. 2.

Use of the grip element 10 can start with the weight support 38 in an extended position as shown in FIG. 2 extending toward th ground or in a coiled position as partially shown in FIG. 1 about the center support 30. With the weight carrier 40 and the weight element(s) 44 suspended at the full length of the weight support 38 as shown in FIG. 2, the user then alternates rotation of his or her hands and the first and second end portions 12 and 14 in one direction, such as away from the user. This has the effect of coiling the weight support 38 about the center support 30 and causing the weight carrier 40 and the internally disposed weight elements 44 to rise toward the grip element 10. At any convenient position or when the weight carrier 40 reaches the annular flanges 26 and 28 on the grip element 10, the user can reverse the direction of rotation of the first and second end portions 12 and 14 causing an uncoiling or extension of the weight support 38 and movement of the weight carrier 40 away from the grip element 10.

This winding and unwinding sequence can be repeated for any number of repetitions as desired by the user. Further, the user may also vary the amount of weight by changing the number of weight elements in the weight carrier 40 between sets of repetitions.

The bi-directional rotation of a user's hands to raise and lower the weight elements will exercise and strengthen the hand, wrist and forearm muscles of a user thereby increasing the user's grip strength.

When the exercise has been terminated, the user can leave the weight elements 44 in the weight carrier 40 when storing the grip element 10 or the user can remove the weight elements 44 from the weight carrier 40 to enable the grip element 10 to be stored in the smallest possible volume.

In summary, there has been disclosed a unique grip exercise apparatus which is lightweight, portable, easy to use, is capable of receiving varying weights, in a single mass or in selectable incremental amounts, to facilitate exercise by users in a wide range of locations.

What is claimed is:

1. An exercise apparatus comprising:

a bar having first and second, opposed hand grippable end portions; and an expansible weight carrier having an interior chamber adapted for receiving objects of varying sizes and shapes extensibly and retractably attached to the bar for movement toward and away from the bar as the bar is rotated by a user's hands gripping the first and second end portions.

2. The exercise apparatus of claim 1 further comprising:

weight support attached to the weight and to the bar, the weight support being windable and unwindable about the bar as the bar is rotated.

3. The exercise apparatus of claim 2 wherein the weight support is a cord.

4. The exercise apparatus of claim 1 wherein the weight element comprises:

a plurality of discrete weight elements.

5. The exercise apparatus of claim 1 wherein the weight element comprises at lease one weight element.

6. The exercise apparatus of claim 1 wherein the bar comprises:

a center portion between the first and second end portions, the center portion including:

first and second spaced annular flanges respectively disposed at an inner end of each of the first and second end portions of the bar;

a support extending between the first and second spaced flanges; and the weight extensibly attached to the support.

7. The exercise apparatus of claim 6 wherein the first and second end portions and the center portion are formed as a unitary, one-piece body.

8. The exercise apparatus of claim 6 wherein the center portion defines an annular recess.

9. The exercise apparatus of claim 8 further comprising:

a weight support attached to support and windable and unwindable about the support in the annular recess as the bar is rotated.

10. The exercise apparatus of claim 1 wherein the first and second end portions of the bar have a hand grippable exterior shape between a larger diameter outer end and a smaller diameter inner end.

11. An exercise apparatus comprising:

a bar having first and second, opposed hand grippable end portions, the bar including:

a center portion between the first and second end portions, the center portion including:

first and second spaced annular flanges respectively disposed at an inner end of each of the first and second end portions of the bar; and a support extending between the first and second spaced flanges; and a weight extensibly attached to the support by a weight support for movement toward and away from the bar as the bar is rotated by a user's hands gripping the first and second end portions, the weight support narrower than a width between the first and second spaced flanges.

12. The exercise apparatus of claim 11 further comprising:

a weight carrier having an interior chamber adapted for receiving objects of varying sizes and shapes.

13. The exercise apparatus of claim 12 wherein the weight carrier is an expansible weight carrier.

14. The exercise apparatus of claim 13 wherein the weight support is a cord.

15. The exercise apparatus of claim 11 wherein the first and second end portions and the center portion are formed as a unitary, one-piece body.

16. The exercise apparatus of claim 11 wherein the center portion defines an annular recess.

17. The exercise apparatus of claim 11 wherein the first and second end portions of the bar have a hand grippable exterior shape between a larger diameter outer end and a smaller diameter inner end.

18. The exercise apparatus of claim 11 wherein the weight support is a cord.

* * * * *